US006112989A

United States Patent [19]

Sheldon

[11] Patent Number: 6,112,989

[45] Date of Patent: Sep. 5, 2000

[54] MOBILE CHECK-IN STATION AND METHOD OF USE

[76] Inventor: Dunstan P. Sheldon, 1752 E. Altadena Dr., Altadena, Calif. 91001

[21] Appl. No.: 09/178,754

[22] Filed: Oct. 26, 1998

[51] Int. Cl.[7] ..... G07B 15/02

[52] U.S. Cl. ..... 235/384; 235/382

[58] Field of Search ..... 235/384, 375, 235/380, 382, 440, 482, 493; 902/18, 22, 24, 30, 39, 40

[56] References Cited

U.S. PATENT DOCUMENTS

| | | | |
|---|---|---|---|
| 4,247,459 | 1/1981 | Yuris et al. | 235/381 |
| 4,600,249 | 7/1986 | Anderson | 312/196 |
| 4,918,298 | 4/1990 | Tanabe et al. | 235/384 |
| 4,928,133 | 5/1990 | Fulton | 346/150 |
| 5,010,240 | 4/1991 | Sheldon | 235/382 |
| 5,056,331 | 10/1991 | Lotz | 62/237 |
| 5,349,534 | 9/1994 | Rousseff et al. | 235/381 X |
| 5,461,219 | 10/1995 | Cronvall | 235/384 |
| 5,558,418 | 9/1996 | Lambright et al. | 312/321.5 |
| 5,599,117 | 2/1997 | Faes et al. | 400/605 |
| 5,632,540 | 5/1997 | Wilcox | 312/197 |
| 5,684,285 | 11/1997 | Faes et al. | 235/449 |
| 5,866,888 | 2/1999 | Bravman et al. | 235/375 |
| 5,913,034 | 6/1999 | Malcolm | 395/200.53 |
| 5,943,651 | 8/1999 | Oosawa | 235/384 X |

*Primary Examiner*—Michael G Lee
*Attorney, Agent, or Firm*—William W. Haefliger

[57] ABSTRACT

In a mobile passenger check-in or gate area station, the combination comprising a mobile cart having ambulatory structure, at least one printer stored in or at the cart and accessible for printing trip tickets or other documents and/or bag tags, and for retrieving of tickets, documents and/or tags when printed, and an electrical power supply on the cart for supplying power to the printer. One or more such carts can be wheeled into position adjacent a fixed check-in or gate area station facility, to support operation of the fixed facility.

3 Claims, 7 Drawing Sheets

MOBILE CHECK-IN STATION AND METHOD OF USE

BACKGROUND OF THE INVENTION

This invention relates generally to passenger check-in-stations, as are needed at facilities such as air terminals; and more particularly has to do with a highly efficient and improved mobile check-in station enabling service of passengers for example at any point in an airport terminal, such as a congested check-in area or a gate area during irregular operations such as cancelled flights, etc.

It is well known that congestion at passenger terminals is a frequent and recurring problem, sometimes leading to missed flights, and ensuing difficulties. Passenger irritation with check-in congestion is another problem. There is need for means to relieve such congestion, and for means to expand check-in capability at difficult check-in points or areas, so as to alleviate such problems.

SUMMARY OF THE INVENTION

It is a major object of the invention to provide a unique, easily transportable, check-in station, movable to and operable in support of a fixed check-in station, or to other points, as needed to alleviate congestion. Basically, the movable check-in station comprises a) a mobile cart having ambulatory means, b) devices stored in or at the cart and including a printer for printing trip documents such as tickets, vouchers, boarding passes, and/or bag tags, and for retrieving of said documents and/or tags when printed, c) said devices also including a computer, keyboard and monitor for interfacing to a host system via a radio-frequency link, and a magnetic stripe reader for reading credit cards and ATB ticket documents, d) and electrical power supply means on the cart for supplying power to said devices.

It is another object to provide said power supply means to include one or both of the following:

i) battery means stored on the cart, ii) an AC input terminal, and a DC to AC inverter carried by the cart.

A further object is to optimally supply battery charging means carried by the cart. Both main and auxiliary batteries may be provided.

Yet another object is to provide a cart that includes a housing having upright side walls, a top counter, a battery storage zone below said top counter, and a cabinet for a computer such as a lap top, and from which the computer is removable onto said top counter.

An added object is to provide lockable housing structures giving access to the printer, and also to the lap-top computer, as required for operation at a selected point in a passenger terminal.

A further object is to provide ambulatory means that include a handle carried by the cart, and there being means operatively connected with the handle, to enable its extension from the cart, and retraction toward the cart. The cart may advantageously have a height of at least about 3.5 feet, and the ambulatory means includes at least two wheels spaced apart by a distance "d", where "d" is at least about 16 inches. Two pivoting wheels, and two non-pivoting wheels may advantageously be provided.

The method of alleviating congestion of passengers at a fixed check-in terminal typically includes $x_1$) providing a mobile check-in station as referred to above, $x_2$) determining the location of passenger congestion occurring at any one of a number of fixed, spaced apart, passenger check-in terminals, $x_3$) and then ambulating the cart to said congested location and operating the printer and other devices at the mobile cart in support of the operation of the fixed terminal.

Several of such mobile carts can be quickly moved to a point of congestion, and operated to quickly alleviate such congestion, reducing passenger irritation, and preventing missed flights, by passengers. The carts can then quickly be moved to other congestion points.

These and other objects and advantages of the invention, as well as the details of an illustrative embodiment, will be more fully understood from the following specification and drawings, in which:

DRAWING DESCRIPTION

Figure 11:
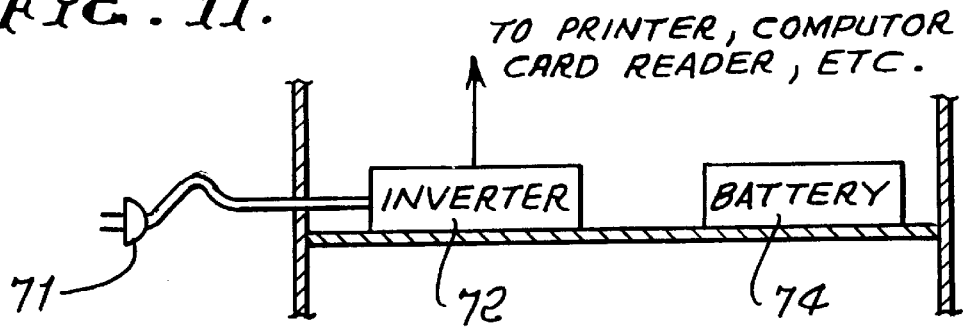

FIG. 11 it is a schematic view of a power supply configuration; and

Figure 12:
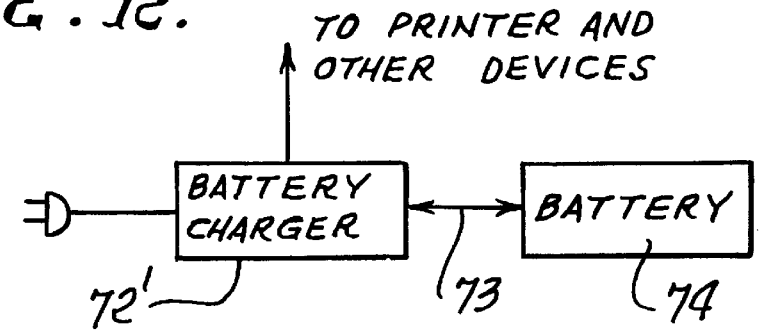

FIG. 12 is a circuit diagram.

DETAILED DESCRIPTION

Figure 9:
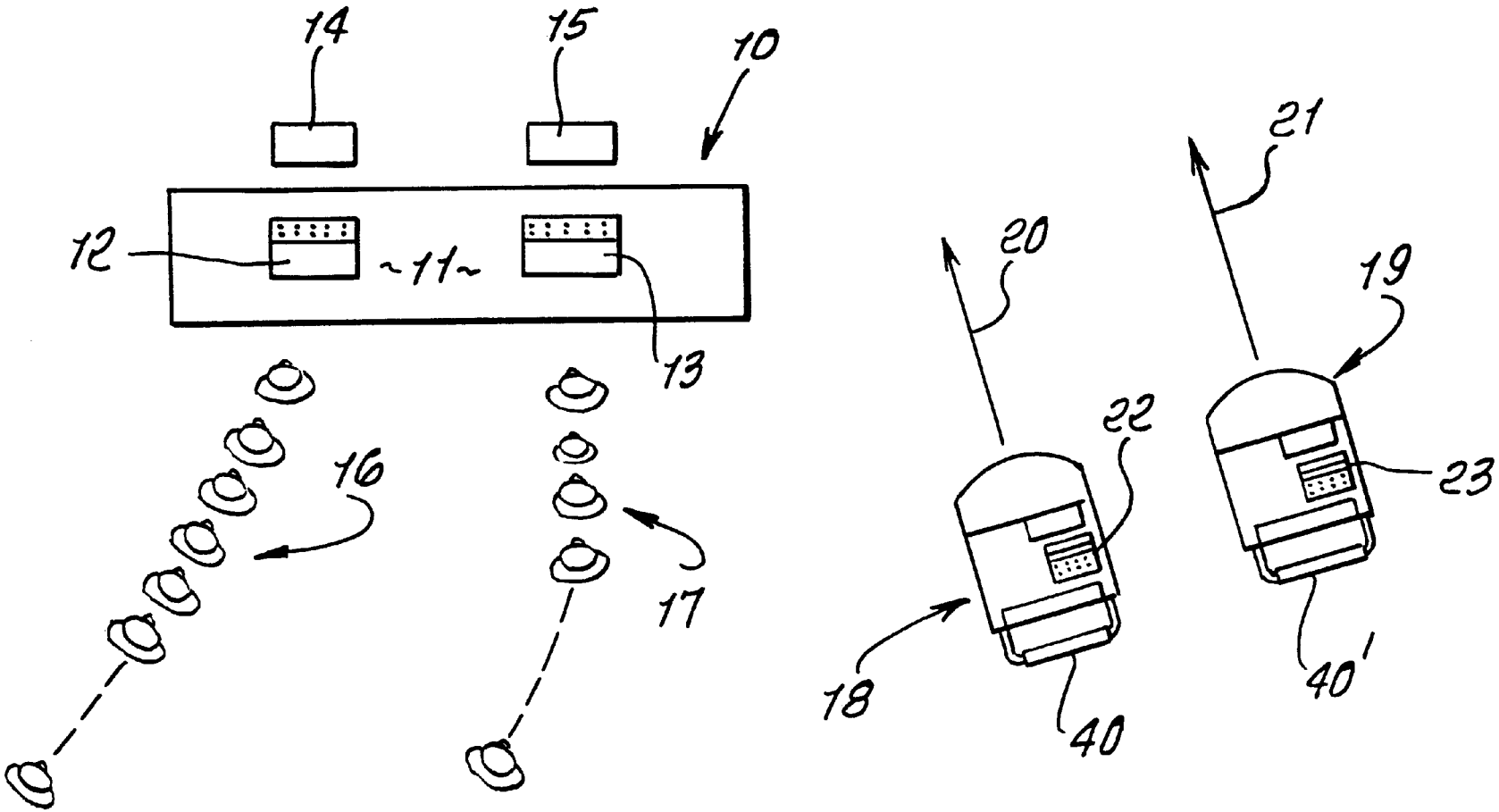
FIG. 9 is a plan view showing two mobile check-in stations being moved toward a fixed check-in station, to alleviate passenger congestion.

Referring first to FIG. 9, it shows a fixed, check-in station 10, as at an airport terminal, and including a desk 11, and computers 12 and 13 operated by clerks sitting at seats 14 and 15. Very elongated rows of waiting passengers are shown at 16 and 17, and congestion exists. For example, one of the computers 12 and 13 may be "down", or temporarily inoperative.

Two mobile check-in stations 18 and 19 are being advanced toward or into proximity to station 10, as indicated by arrows 20 and 21, to assist in passenger check-in. Just one of 18 and 19 may be used.

Figure 10:
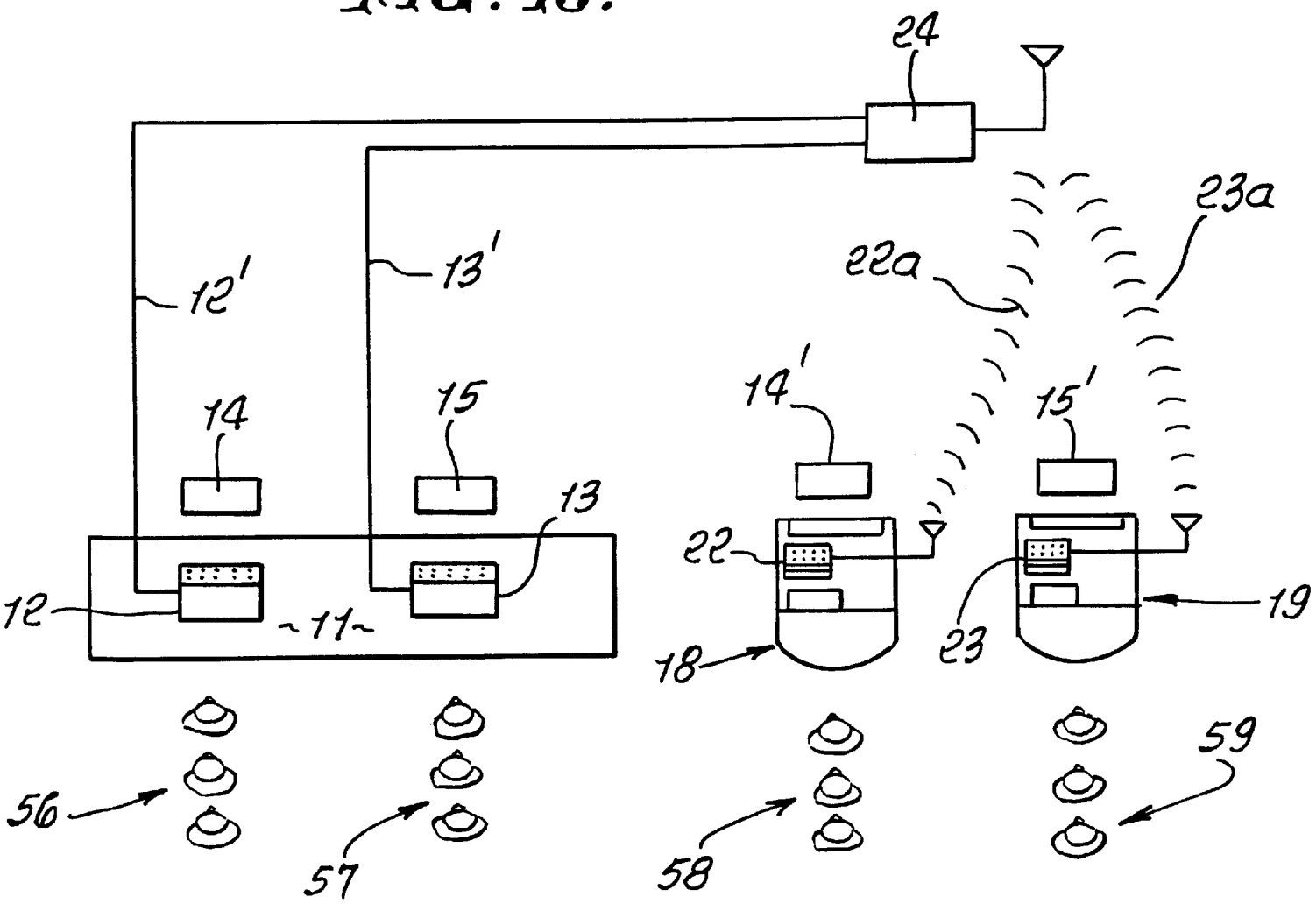
FIG. 10 is a view like FIG. 9, but showing the two mobile stations in place, and assisting the fixed station, alleviating such congestion.

FIG. 10 shows the two mobile stations 18 and 19 now in position and operating to assist fixed station 10. Computers 22 and 23 on the carts defined by stations 18 and 19 are connected by two-way radio frequency links 22*a* and 23*a* with a host computer or computers 13. The latter is or are connected via cables 12' and 13' to the computers 12 and 13; accordingly, data is transmitted between the host computer and all desk and card computers, for cross-checking passenger status, etc. Shortened rows of waiting passengers are seen at 56–59. Handle bars 40 and 40' used for pushing the carts 18 and 19 in FIG. 9 are stored in the carts, in FIG. 10. Like carts 18 and 19 have ambulatory means to enable their travel use in an airport terminal, and such means may include wheels 85 supporting the carts, as also seen in FIGS. 1–8.

The method of provision and use, as contemplated in FIGS. 9 and 10, includes the steps:

$x_1$) providing a mobile check-in station as described, $x_2$) determining the location of passenger congestion occurring at any one of a number of fixed, spaced apart, passenger check-in terminals, or at gate locations, $x_3$) and then ambulating the mobile station to said congested location and operating a printer and/or other device including a computer at the mobile station in support of the operation of equipment at said fixed terminal.

Airport personnel as at station 10 may observe or determine need for an additional station or stations, as at 18 and/or 19, and call for their supply, as shown in FIGS. 9 and 10.

Referring now to FIGS. 1–8, a mobile passenger check-in station includes cart 18 that has a housing 25 with upright side walls 26 and 27, a top counter 28, a curved front wall 29 and a rear wall 30. The side walls are upwardly extended at 26*a* and 27*a*, to project above the level of the counter 28; and a top cover is provided at 31 to interconnect 26*a* and 27*a*, and to connect to the top of front wall 29, forming a concealed storage below 31.

At least one printer is stored in or at the cart to be accessible for printing trip tickets and/or bag (luggage) tags, and for retrieving of said tickets and/or tags, when printed. See for example the ticket printing equipment 35 in FIG. 2, stored in a cart compartment 36 just below the counter 28, and having a printed ticket or tag delivery slot 35*a*. The printer may be of IER type. The bag tag printer 37 and delivery slot 37*a* may be a UBI type. A stored ticket stack is seen at 60 in FIGS. 6 and 7. A door 38 of the cart (see FIG. 5) is hinged to allow access to the printer or printers, and door 38 is unlocked and dropped down to allow access to the printers. A lock for the door is shown at 41. Legs 42 and 43 attached to push handle bar 40 may be pushed into guide slots 44 and 45 in the housing to allow the handle to be out of the way when the cart is in working position (see FIG. 10).

Figure 7:
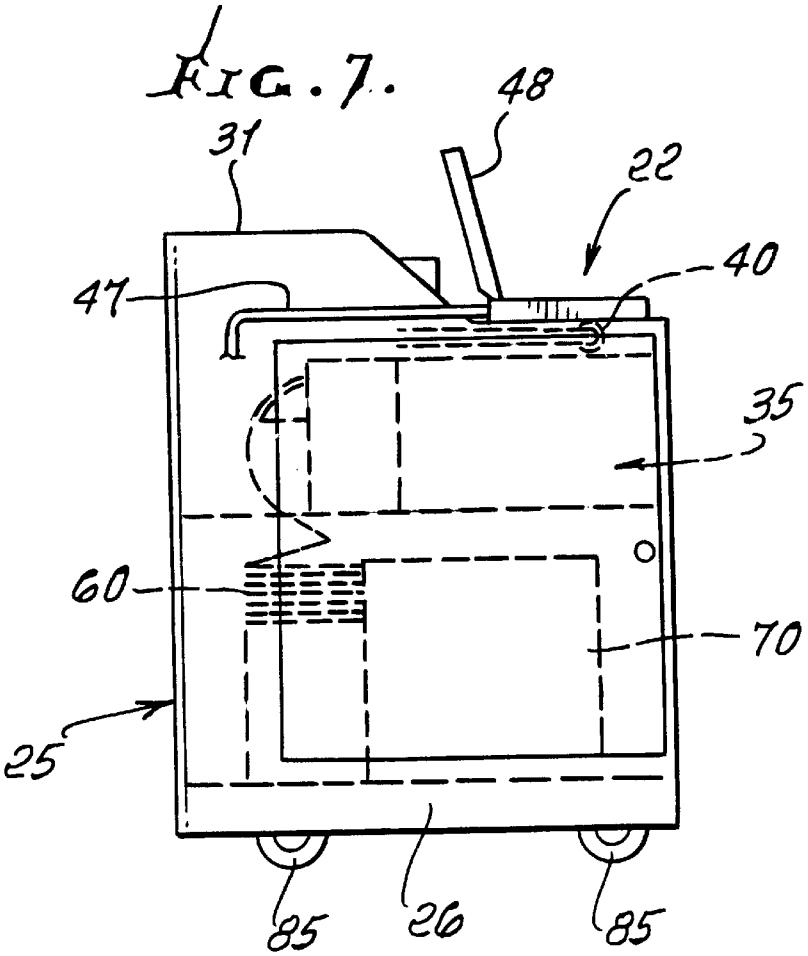
FIG. 7 is an enlarged left side view of the FIG. 2 apparatus.
Figure 6:
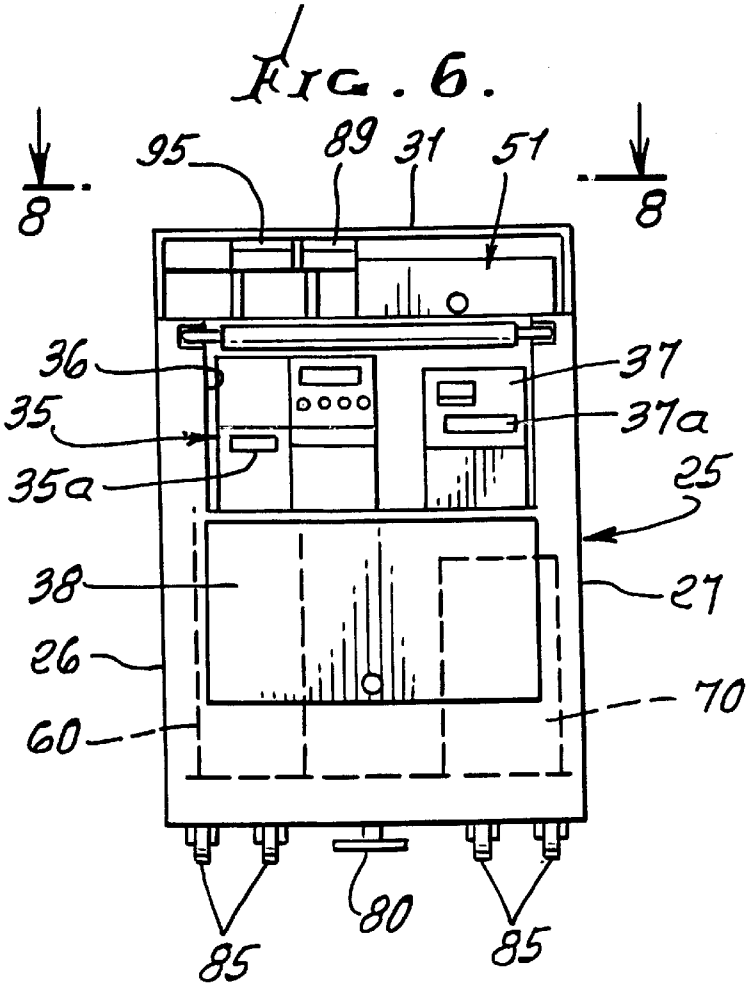
FIG. 6 is an enlarged front view of the FIG. 2 apparatus.
Figure 8:
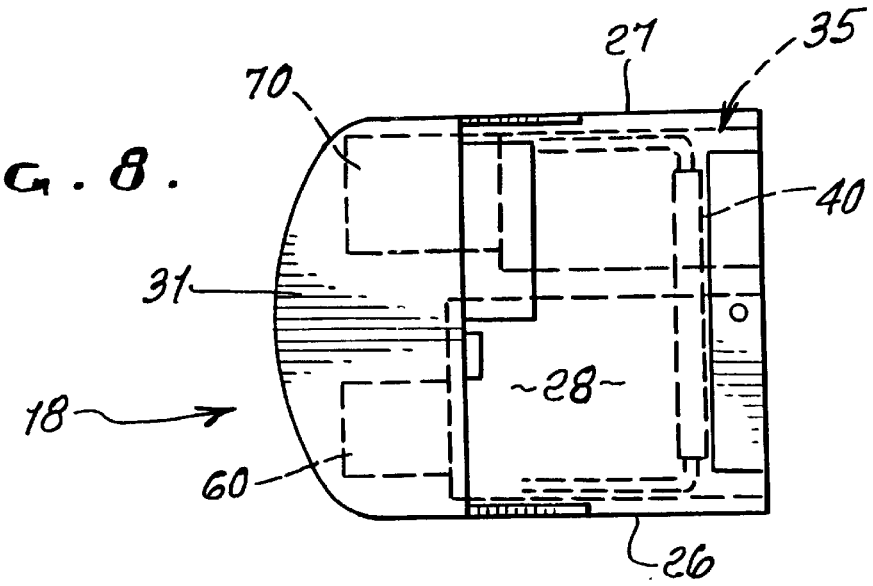
FIG. 8 is a top plan view taken on lines 8—8 of FIG. 6.

Computer 22 on the cart is cable connected to the printer, as at 47 (see FIG. 7). Computer 22 may be of lap-top (reduced) size, and may have a fold-down cover 48 carrying a display screen 49. When cover 48 is down-folded, the computer can be slid forwardly into a desk-like cabinet 51 fixed in position below cover 31. A lock 52 is provided for the openable front door 53 of the cabinet 51. See FIG. 1.

For maneuverability and ease of use, the cart preferably has a height of under 4 feet, and the ambulatory means typically includes at least two wheels spaced apart by a distance "d", where "d" is at least about 16 inches. See wheels 85 at the bottom of the cart to support it for rolling into selected positions. Two sets of wheels may be provided. The cart may have one or two openable side walls, and a lock for an openable wall 26 is shown at 55. Such a side wall allows access to electrical power supply means on the cart, for supplying power to the printer, and for access to the printer. Such power supply means typically includes a UPS controller 70 and battery pack of up to four (4) batteries (26 amp hours), and/or an AC input terminal 71 and inverter (UPS) 72 carried by the cart. See also FIG. 11. Battery charging means may also be supplied, by inverter (UPS) 72' connected by cable 73 to the battery 74. See FIG. 12. A smoothing filter may be used if needed.

SUMMARY

The invention provides a compact, easy to move, complete mobile check-in station. It provides a carrier cart with great flexibility to serve passengers at any point of congestion in the airport. It will operate on batteries, or it can be connected to a standard AC power outlet. The mobile station is typically equipped with RF communications (see antenna 88) so that it is completely flexible as to where it can be positioned and operated.

The mobile check-in station provides the agent with all the tools necessary to handle both ticketed passengers and those using Electronic Tickets. The station (FIG. 1) is typically equipped with:

A Lap Top Computer of the carrier's choice.

A Single, two or three Bin automatic ticket and boarding pass (ATB) Printer. This has revalidation ability, and with a 300 dpi resolution print head can use blank $ATB_2$ Type 3 documents. This allows for printing the ATB headings for ATB tickets as well as other documents with meaningful headings. Only one bin would be required with a high resolution print head.

Bag Tag Printer, of carrier's choice. A UBI or Texas Instruments (TI) 201 bag tag printer can be installed.

A motorized MagTek credit card/Smart Card reader is or can be provided, as at 89. See FIG. 6.

A battery status display is provided at 95 on the counter so that the agent knows when the battery is getting low.

An Uninterruptible Power Supply is provided. This allows for battery operation or standard 120 VAC or 240 VAC power.

The mobile cart will hold an IER ATB Printer and a UBI Bag Tag Printer. All cables are enclosed by the back of the cart. The back of the unit projects upwardly to protect cables, so that none are exposed to the public. It also allows protection for a large roll of bag tags (stored in printer) and the use of fan-fold ATBs which are stored inside the cart and are fed through the back of the IER ATB Printer. Fan-fold ATBs are typically used, with revalidation means in the printer. This allows the agent to read any ATB that a ticketed passenger has, and to issue bag tags and do revalidation of the ATB—change seat, flight, etc. This way the agent can handle both electronic ticket (ET) passengers and ticketed passengers.

The card has a light emitting diode (LED) status panel as at 95 which shows the status of the power system.

| | |
|---|---|
| 1. Battery | Green-OK<br>Yellow-low<br>Red-out |
| 2. AC Power | On-green |

One battery pack (4 batteries) is used, and should be operable for 7 to 8 hours of use. If the battery pack goes to "low" while an agent is processing passengers, the agent will complete a transaction and then have a re-charged battery brought to the cart, for replacing the low battery.

Also, the batteries preferably have their own UPS chargers built in so that they can be charged by plugging in the AC power cord and the batteries are then charged while the cart carried devices are operating on AC power.

The cart has rubber, ball bearing casters or wheels. The rear casters are fixed and the front casters swivel for guidance. The handle, in one position, allows the cart to move. When the handle is in a second position, the cart is locked and will not move.

The mobile check-in station is usable at gate areas, and instead of having an ATB printer and bag tag printer, a gate reader may be provided on the cart and battery operated.

Also, another option is to remove the lap top computer unit and replace with a flat panel screen and keyboard in that area. A PC can be located inside so as to provide a complete terminal using RF communication with the host computer.

Figure 1:
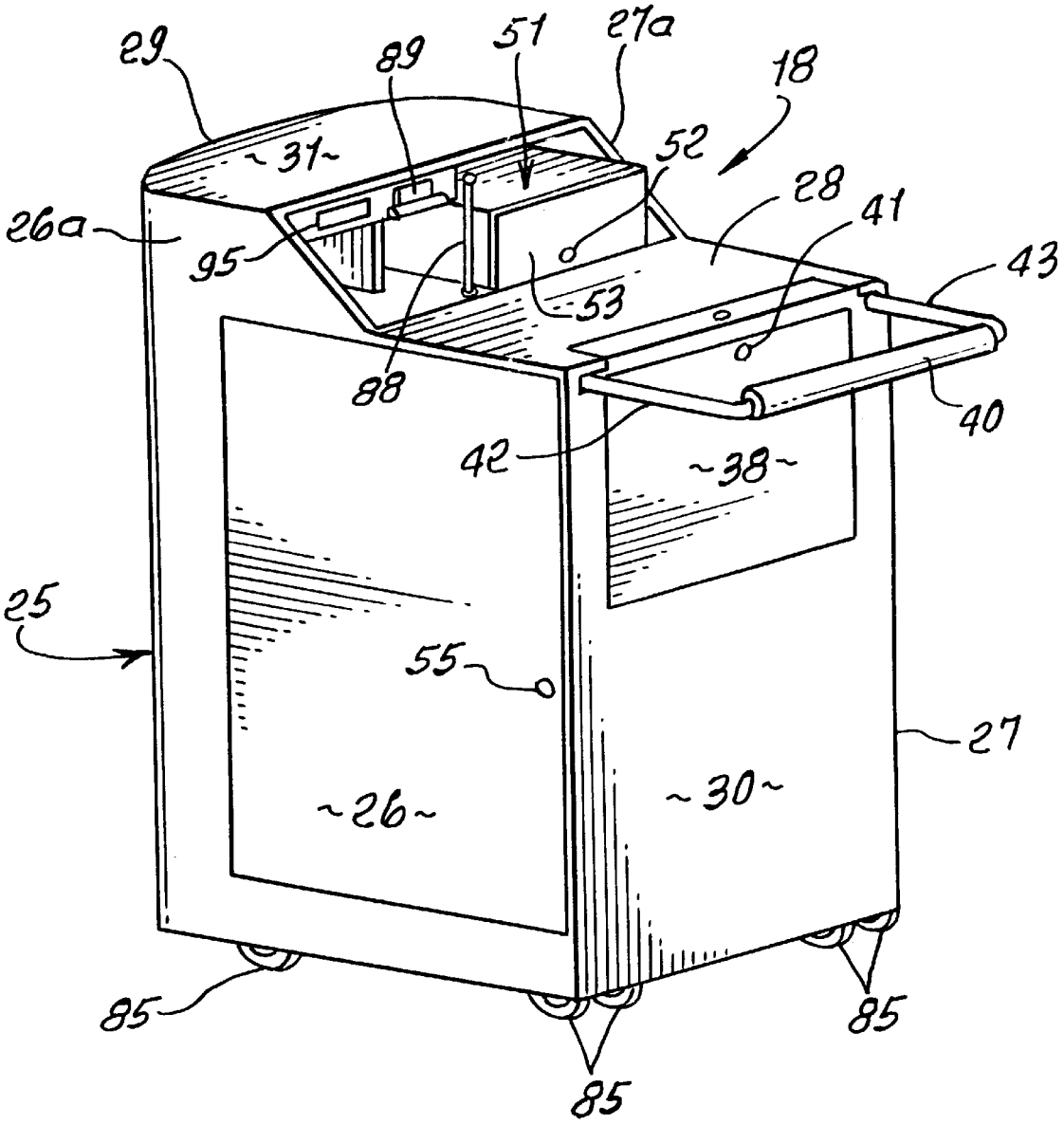
FIG. 1 is a perspective view of a mobile check-in station incorporating the invention, and in an ambulatory mode.
Figure 2:
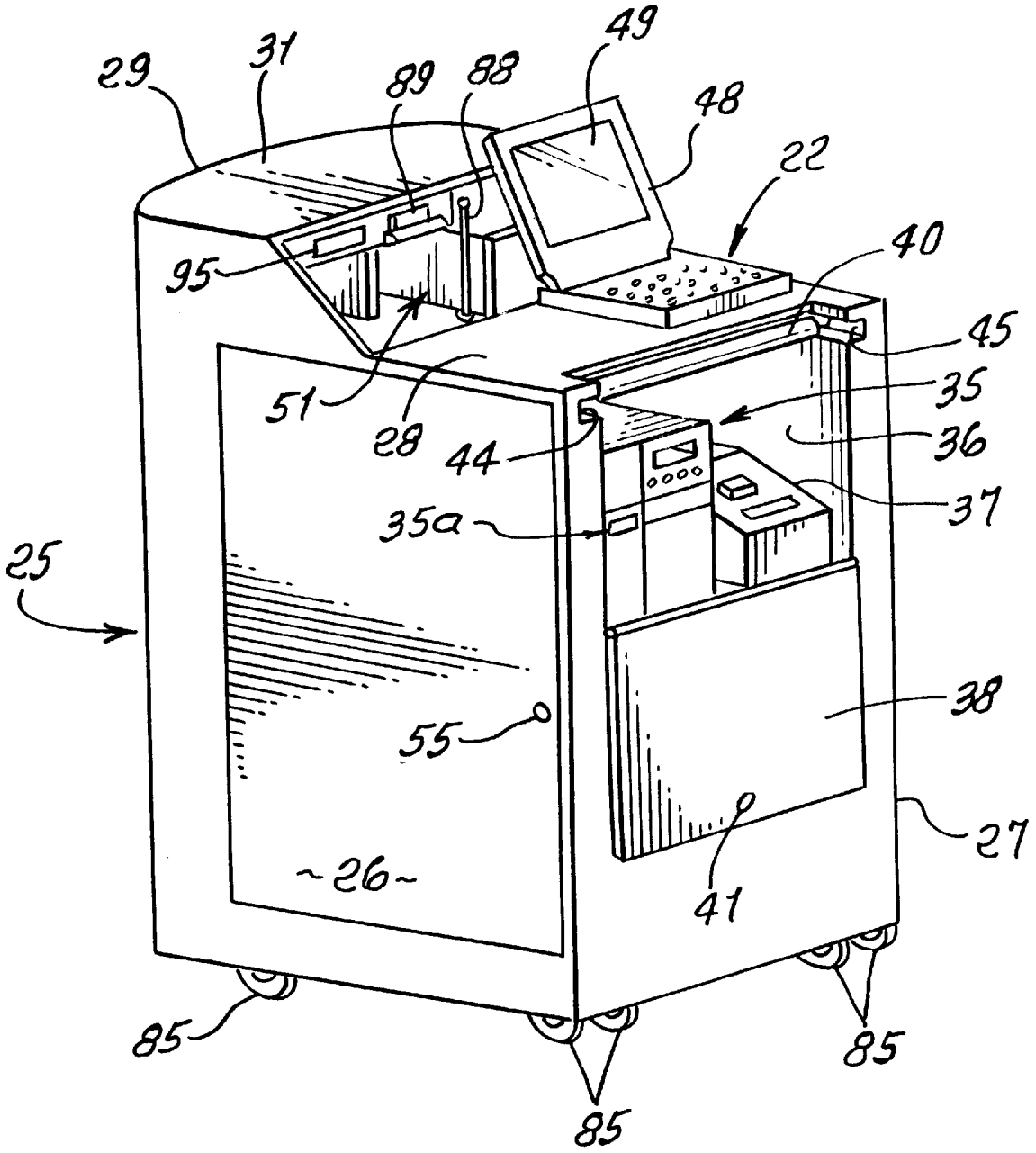
FIG. 2 is a view like FIG. 1, showing the station in a passenger check-in mode.
Figure 3:
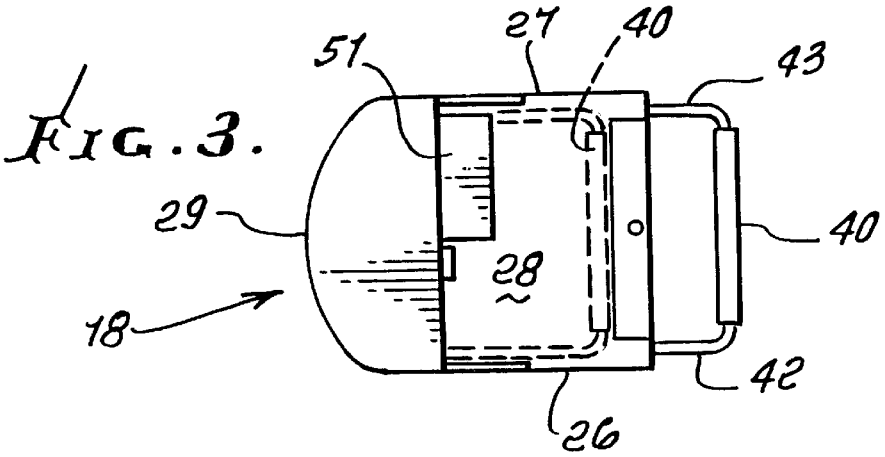
FIGS. 3, 4 and 5 are top, side and front views, respectively, of the FIG. 1 apparatus.
Figure 4:
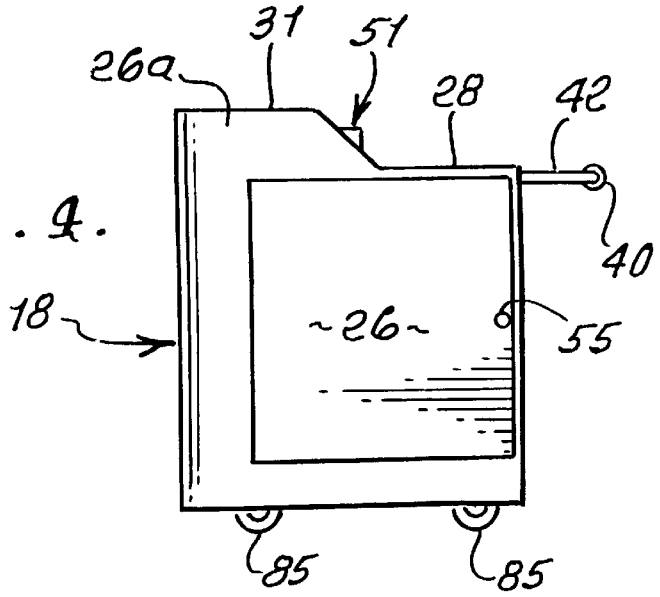
Figure 5:
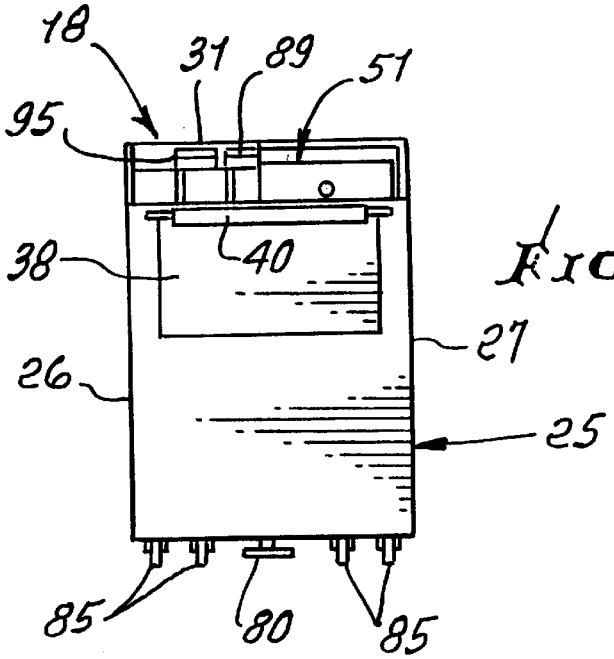

FIG. 5 shows provision of a foot lock 80, activated by downward foot pressure. The lock can be released by pressing down a second time by the user's foot.

The access doors of the cart allow for ease of forms (tickets, tags, etc.) replacement, and access to the printers and batteries.

I claim:

1. The method of alleviating congestion at a passenger fixed check-in or gate area terminal that includes a computer and printer(s), that includes $x_1$) providing a mobile check-in station that includes a) a mobile cart having an ambulatory element or elements, b) a computer and at least one printer stored in or at the cart and accessible for use in printing trip documents or bag tags, at the cart, and for retrieving of said documents or tags when printed, c) an electrical power supply on the cart for supplying power to said printer and computer at the cart, said power supply including a battery provided and carried at a low level location in the cart, $x_2$) determining the location of passenger congestion occurring at any one of a number of fixed, spaced apart, passenger check-in terminals, $x_3$) then ambulating said mobile station to said location, and exchanging information between said mobile station and said one, fixed check-in terminal, via RF communication from the mobile station to a host computer, said exchanging including operating the printer and computer at said mobile station in support of the operation of said computer and printer at said fixed terminal; and wherein said cart includes a housing having upright side walls, a top counter, a battery storage zone below said top counter, and a cabinet for the computer at the cart for use proximate said top counter, the cart having a forward edge, a rearward zone, a push handle at said rearward zone, the top counter located between said forward edge and said handle.

2. The method of claim 1 including providing at least one of said side walls to be openable, and providing a lock to lock said openable side wall in closed position, the openable side wall providing access to said battery at said lower level location in the cart, and to storage for automatic ticket and boarding passes.

3. The method of claim 1 including providing and operating multiple of said mobile stations at said location, to communicate with the host computer and support operation of the fixed terminal.

* * * * *